US011993929B2

(12) United States Patent
Wu et al.

(10) Patent No.: US 11,993,929 B2
(45) Date of Patent: May 28, 2024

(54) MODULAR CURTAIN WALL AND INSTALLING METHOD FOR THE SAME

(71) Applicant: GUANGDONG CIMC BUILDING CONSTRUCTION CO., LTD., Jiangmen (CN)

(72) Inventors: Jieyuan Wu, Jiangmen (CN); Zhaotie Luo, Jiangmen (CN); Yang Chen, Jiangmen (CN)

(73) Assignee: GUANGDONG CIMC BUILDING CONSTRUCTION CO., LTD., Jiangmen (CN)

( * ) Notice: Subject to any disclaimer, the term of this patent is extended or adjusted under 35 U.S.C. 154(b) by 219 days.

(21) Appl. No.: 17/637,063

(22) PCT Filed: Aug. 21, 2020

(86) PCT No.: PCT/CN2020/110609
§ 371 (c)(1),
(2) Date: Feb. 21, 2022

(87) PCT Pub. No.: WO2021/032204
PCT Pub. Date: Feb. 25, 2021

(65) Prior Publication Data

US 2022/0298787 A1 Sep. 22, 2022

(30) Foreign Application Priority Data

Aug. 22, 2019 (CN) ..... 201910779518.2

(51) Int. Cl.
*E04B 2/96* (2006.01)
*E04B 1/348* (2006.01)
*E04B 1/68* (2006.01)

(52) U.S. Cl.
CPC ..... *E04B 2/965* (2013.01); *E04B 1/3483* (2013.01); *E04B 1/6813* (2013.01); *E04B 2/967* (2013.01)

(58) Field of Classification Search
None
See application file for complete search history.

(56) References Cited

U.S. PATENT DOCUMENTS 4,619,092 A * 10/1986 Kaminaga ..... E04B 2/96 52/302.1
4,662,136 A 5/1987 Tanikawa et al.
(Continued)

FOREIGN PATENT DOCUMENTS

CA 2913749 A1 8/2016
CA 2913749 C 3/2019
(Continued)

OTHER PUBLICATIONS

International Patent Application No. PCT/CN2020/110609; Int'l Written Opinion and Search Report; dated Nov. 11, 2020; 7 pages.

*Primary Examiner* — Joshua K Ihezie
(74) *Attorney, Agent, or Firm* — BakerHostetler

(57) ABSTRACT

A modular curtain wall and an installing method for the same are provided. The modular curtain wall comprises a steel structure module, a curtain wall module, and a first waterproof member. The steel structure module includes a steel structure body and a mount, and the curtain wall module includes a curtain wall body, a hook, and a first seal. When the hook is hung on the mount, the relative position between the curtain wall body and the steel structure body is adjustable in a front-back direction, the left-right direction, and an up-down direction of the steel structure body.

18 Claims, 14 Drawing Sheets

(56) References Cited

U.S. PATENT DOCUMENTS

| | | | | |
|---|---|---|---|---|
| 5,067,300 | A * | 11/1991 | Takeda | E04B 2/90 52/745.1 |
| 5,127,202 | A | 7/1992 | Yokota et al. | |
| 9,637,933 | B2 | 5/2017 | Zhou et al. | |
| 11,719,012 | B2 * | 8/2023 | Richard | F16B 5/0241 52/167.1 |
| 2016/0244967 | A1 | 8/2016 | Zhou et al. | |
| 2017/0260751 | A1 | 9/2017 | Zhou et al. | |
| 2018/0320372 | A1 * | 11/2018 | Daudet | E04B 2/789 |
| 2019/0234071 | A1 * | 8/2019 | Claeys | E06B 3/5427 |
| 2021/0404181 | A1 * | 12/2021 | Naim Ibrahim | E04B 1/68 |
| 2022/0282479 | A1 * | 9/2022 | Budd | E04B 1/41 |
| 2023/0183968 | A1 * | 6/2023 | Chiti | E04B 2/967 52/235 |

FOREIGN PATENT DOCUMENTS

| | | | |
|---|---|---|---|
| CN | 202194278 | U | 4/2012 |
| CN | 202194281 | U | 4/2012 |
| CN | 203640115 | U | 6/2014 |
| CN | 203891272 | U | 10/2014 |
| CN | 109537785 | A | 3/2019 |
| CN | 110886415 | A | 3/2020 |
| JP | H10-183786 | A | 7/1998 |
| JP | H11-062035 | A | 3/1999 |
| KR | 2016-0136945 | A | 11/2016 |
| KR | 10-1717746 | B1 | 3/2017 |

* cited by examiner

MODULAR CURTAIN WALL AND INSTALLING METHOD FOR THE SAME

CROSS-REFERENCE TO RELATED APPLICATIONS

This application is the National Stage of International Patent Application No. PCT/CN2020/110609, filed on Aug. 21, 2020, which claims the priority to Chinese Patent Application No. 201910779518.2, filed on Aug. 22, 2019, the disclosures of which are incorporated herein by reference in their entireties.

TECHNICAL FIELD

The present disclosure generally relates to the field of container-based prefabricated construction, and more specifically relates to a modular curtain wall and an installing method for the same.

BACKGROUND

Among all modular building types, the containerized modular building is a mode with the highest completion rate of internal prefabrication. In the containerized modular building, various building modules will be manufactured and assembled in the factory as much as possible. At the construction site, there is only a need to complete the splicing of various building modules and treatment on the joints, which can accomplish the installation of the modular building.

The process of installing a curtain wall on a building module (such as a container) is substantially the same as the installing the containerized modular building described above. Part panels of the curtain wall are installed on the building modules in the factory, and the curtain wall panels are required to be installed to the joints of the building modules at the construction site. In this way, it is necessary to build scaffolding and other safety maintenance facilities on site. Therefore, the construction period is relatively long and the construction cost is relatively high.

Therefore, it is necessary to provide a modular curtain wall and an installing method of the modular curtain wall to at least partially solve the above-mentioned problems.

SUMMARY

A series of simplified concepts is introduced into the portion of Summary, which would be further illustrated in the portion of the detailed description. The Summary of the present disclosure does not mean attempting to define the key feature and essential technical feature of the claimed technical solution, let alone determining the protection scope thereof.

In order to at least partially solve the above technical problems, according to one aspect of the present disclosure, a modular curtain wall is provided. The modular curtain wall comprises a steel structure module including a steel structure body, a mount disposed on the steel structure body, and a first seal; a curtain wall module including a curtain wall body and a hook disposed on the curtain wall body, the hook being corresponding to the mount, the hook being used to be hung on the mount such that the curtain wall body is fixed to the steel structure body, the first seal being disposed at left and right ends of the curtain wall body; a first waterproof member being used to be disposed in a splicing gap between the adjacent curtain wall modules when at least two curtain wall modules are spliced in a left-right direction of the steel structure body, the first seal abutting against the first waterproof member to seal the splicing gap; wherein, when the hook is hung on the mount, the relative position between the curtain wall body and the steel structure body is adjustable in a front-back direction, the left-right direction, and an up-down direction of the steel structure body.

According to the modular curtain wall of the present disclosure, disposing the mount and the hook makes it possible that the curtain wall module can be hung on the steel structure module by a hoisting equipment, and that the relative position between the curtain wall module and the steel structure module is adjustable in the front-back direction, left-right direction, and up-down direction of the steel structure module, which is convenient to adjust the position between the curtain wall module and the steel structure module. The first seal and the first waterproof member cooperate to seal the splicing gap between the adjacent curtain wall modules. As such, components of the steel structure module, components of the curtain wall module, and the first waterproof member can be manufactured in the manufacturing plant, and the steel structure module and the curtain wall module can be pre-assembled. Then, the first waterproof member, the assembled steel structure module and the assembled curtain wall module are transported to a site to be installed and are installed by a hoisting equipment. This abandons the need of dealing with the joints, and therefore the need to build scaffolding and other safety maintenance facilities on site, which thereby shortens the construction period, reduces the construction cost, and achieves the full prefabrication of the steel structure module and the curtain wall module of the modular curtain wall, making installing convenient.

Alternatively, the mount includes a first mount and a second mount. The first mount is connected to the steel structure body. The second mount is movably connected to the first mount along the front-back direction. The hook includes a connecting portion and a hooking portion. The connecting portion is connected to the curtain wall body. The hooking portion is movably connected to the connecting portion along the up-down direction. The hooking portion is provided with a notch with an opening facing downward and is movably hung on the second mount through the notch along the left-right direction.

Alternatively, the curtain wall module further includes an installing groove and an installing protrusion corresponding to the installing groove, wherein the installing groove is disposed at the top of the curtain wall body and the installing protrusion is disposed at the bottom of the curtain wall body, or the installing groove is disposed at the bottom of the curtain wall body and the installing protrusion is disposed at the top of the curtain wall body.

Alternatively, the curtain wall module further includes a second seal positioned in the installing groove.

Alternatively, the curtain wall module further includes an intermediate member of a shape corresponding to the installing protrusion and the installing groove, the intermediate member being movably disposed in the installing groove along the left-right direction and used to cover the part of the splicing gap between the adjacent curtain wall modules in the installing groove when at least two curtain wall modules are spliced along the left-right direction; and/or the curtain wall module further includes a waterproof glue piece used to cover the part of the splicing gap at the top of the curtain wall module when at least two curtain wall modules are spliced along the left-right direction, the waterproof glue piece being positioned outside the installing groove.

Alternatively, the curtain wall module further includes a third seal positioned on an end surface of at least one of left and right ends of the curtain wall body, and when at least two curtain wall modules are spliced along the left-right direction, the third seal is positioned at the splicing gap between the adjacent curtain wall modules to seal the splicing gap between the adjacent curtain wall modules.

Alternatively, a cross-section of the first waterproof member is a T-shaped structure, the first seal abutting on either side of both ends of a transverse arm of the T-shaped structure such that the third seal, the T-shaped structure, and the first seal form a multi-layer sealing structure at the splicing gap.

Alternatively, there is a gap between the steel structure body and the curtain wall body, the steel structure body having an internal space and an opening in communication with the internal space; wherein the steel structure module further includes a frame disposed in the gap, one end of the frame being connected to the opening of the steel structure body, the other end of the frame being used to be sealingly connected with the curtain wall body, the frame and the opening defining a channel; wherein at least one of a surface forming the channel and a surface forming the internal space is provided with a fireproof layer.

Alternatively, there is a gap between the steel structure body and the curtain wall body, and the steel structure module further includes a second waterproof member disposed in the gap, a first end of the second waterproof member being circumferentially connected to the surface of the steel structure body facing the curtain wall module, a second end of the second waterproof member being opposite to the first end and being used to be glued to the surface of the curtain wall body facing towards the surface of the steel structure body.

The present disclosure also provides an installing method of a modular curtain wall. The installing method is used to install the aforesaid modular curtain wall, and the installing method includes:

assembling and providing:

a steel structure module including a steel structure body and a mount disposed on the steel structure body;

at least two curtain wall modules, each including a curtain wall body, a hook disposed on the curtain wall body, and a first seal, wherein the hook is corresponding to the mount and used to be hung on the mount such that the curtain wall body is fixed to the steel structure body, and the first seal is disposed at left and right ends of the curtain wall body; and a first waterproof member;

transporting all of the steel structure module, the curtain wall module, and the first waterproof member to a site where the modular curtain wall is to be installed;

fixedly disposing the steel structure module;

hanging the hook on the mount, such that, when the hook is hung on the mount, the relative position between the curtain wall body and the steel structure body is adjustable in a front-back direction, the left-right direction, and an up-down direction of the steel structure body; and inserting the first waterproof member into a splicing gap between two adjacent curtain wall modules of a layer of the modular curtain wall when the two adjacent curtain wall modules are spliced in the left-right direction of the steel structure body, such that the first seal abuts against the first waterproof member to seal the splicing gap.

According to the installing method of the modular curtain wall of the present disclosure, the installing method is used to install the aforesaid modular curtain wall. Disposing the mount and the hook makes it possible that the curtain wall module can be hung on the steel structure module by a hoisting equipment, and that the relative position between the curtain wall module and the steel structure module is adjustable in the front-back direction, left-right direction, and up-down direction of the steel structure module, which is convenient to adjust the position between the curtain wall module and the steel structure module. The first seal and the first waterproof member cooperate to seal the splicing gap between the adjacent curtain wall modules. As such, components of the steel structure module, components of the curtain wall module, and the first waterproof member can be manufactured in the manufacturing plant, and the steel structure module and the curtain wall module can be pre-assembled. Then, the first waterproof member, the assembled steel structure module and the assembled curtain wall module are transported to a site to be installed and are installed by a hoisting equipment. This abandons the need of dealing with the joints, and therefore the need to build scaffolding and other safety maintenance facilities on site, which thereby shortens the construction period, reduces the construction cost, and achieves the full prefabrication of the steel structure module and the curtain wall module of the modular curtain wall, making installing convenient.

Alternatively, the step of assembling and providing the steel structure module, curtain wall modules, and first waterproof member includes: configuring the mount to include a first mount and a second mount, the first mount being connected to the steel structure body, the second mount being movably connected to the first mount along the front-back direction; and configuring the hook to include a connecting portion and a hooking portion, the connecting portion being connected to the curtain wall body, the hooking portion being movably connected to the connecting portion along the up-down direction; wherein the hooking portion is provided with a notch with an opening facing downward and is movably hung on the second mount through the notch along the left-right direction.

Alternatively, the step of assembling and providing the steel structure module, curtain wall modules, and first waterproof member includes: configuring the curtain wall module to further include an installing groove and an installing protrusion corresponding to the installing groove, such that the installing groove is disposed at the top of the curtain wall body and the installing protrusion is disposed at the bottom of the curtain wall body, or the installing groove is disposed at the bottom of the curtain wall body and the installing protrusion is disposed at the top of the curtain wall body.

Alternatively, the step of assembling and providing the steel structure module, curtain wall modules, and first waterproof member includes: configuring the curtain wall module to further include a second seal positioned in the installing groove.

Alternatively, the step of assembling and providing the steel structure module, curtain wall modules, and first waterproof member includes: configuring the curtain wall module to further include an intermediate member of a shape corresponding to the installing protrusion and the installing groove, the intermediate member being movably disposed in the installing groove along the left-right direction, the intermediate member being used to cover the part of the splicing gap between the adjacent curtain wall modules in the installing groove when at least two curtain wall modules are spliced along the left-right direction; and/or configuring the curtain wall module to further include a waterproof glue piece used to cover the part of the splicing gap at the top of the curtain wall module when at least two curtain wall modules are spliced along the left-right direction, the waterproof glue piece being positioned outside the installing groove.

Alternatively, the step of assembling and providing the steel structure module, curtain wall modules, and first waterproof member includes: configuring the curtain wall module to further include a third seal positioned on an end surface of at least one of left and right ends of the curtain wall body, such that when at least two curtain wall modules are spliced along the left-right direction, the third seal is positioned at the splicing gap between the adjacent curtain wall modules to seal the splicing gap between the adjacent curtain wall modules.

Alternatively, the step of assembling and providing the steel structure module, curtain wall modules, and first waterproof member includes: configuring the first waterproof member to have a cross-section of a T-shaped structure, and providing the first seal abutting on either side of both ends of a transverse arm of the T-shaped structure, such that the third seal, the T-shaped structure, and the first seal form a multi-layer sealing structure at the splicing gap.

Alternatively, the step of assembling and providing the steel structure module, curtain wall modules, and first waterproof member includes: providing a gap between the steel structure body and the curtain wall body; configuring the steel structure body to have an internal space and an opening in communication with the internal space; and configuring the steel structure module to further include a frame disposed in the gap, wherein one end of the frame is connected to the opening of the steel structure body, and the other end of the frame is used to be sealingly connected with the curtain wall body, such that the frame and the opening defines a channel, and at least one of a surface forming the channel and a surface forms the internal space is provided with a fireproof layer.

Alternatively, the step of assembling and providing the steel structure module, curtain wall modules, and first waterproof member includes: providing a gap between the steel structure body and the curtain wall body, and configuring the steel structure module to further include a second waterproof member disposed in the gap, such that a first end of the second waterproof member is circumferentially connected to the surface of the steel structure body facing the curtain wall module, and a second end of the second waterproof member is opposite to the first end and used to be glued to the surface of the curtain wall body facing towards the surface of the steel structure body.

BRIEF DESCRIPTION OF THE DRAWINGS

In order to make the advantages of the present disclosure easier to be understood, the present disclosure briefly described above will be described in more detail by referring to specific embodiments shown in the accompanying drawings. It can be understood that these drawings only depict typical embodiments of the present disclosure, and therefore it should not be considered as limiting the protection scope thereof. The present disclosure is described and explained with additional features and details through the accompanying drawings.

DESCRIPTION OF REFERENCE SIGNS

| | |
|---|---|
| 110: Steel structure module | 111: Mount |
| 112: Frame | 113: Channel |
| 114: Second waterproof member | 115: Second internal through hole |
| 120: Curtain wall module | 121: hook |
| 122: Installing groove | 123: Installing protrusion |
| 124: Second seal | 125: Waterproof glue piece |
| 126: Intermediate member | 127: Third seal |
| 128: First waterproof member | 129: First seal |
| 130: Fireproof board | |

DETAILED DESCRIPTION

In the following description, numerous specific details are set forth in order to provide a more thorough understanding of the present disclosure. However, it is obvious to those skilled in this art that the present disclosure may be implemented without one or more of these details. Some technical features well-known in this art are not described in other examples in order to avoid confusion with the present disclosure.

In order to thoroughly understand the embodiments of the present disclosure, a detailed structure will be proposed in the following description. Obviously, the implementation of the present disclosure is not limited to the specific details familiar to those skilled in the field. The preferred embodiments of the present disclosure are described in detail as follows. However, in addition to these detailed descriptions, the present disclosure may have other embodiments.

A preferred embodiment of the present disclosure provides a modular curtain wall. As shown in FIGS. 1 to 14, the modular curtain wall includes a steel structure module 110 and a curtain wall module 120. The steel structure module 110 and the curtain wall module 120 of the modular curtain wall can be manufactured and pre-assembled in their respective production plants. The steel structure module 110 and the curtain wall module 120 are then transported to the site to be installed. After the steel structure module 110 is fixed, the curtain wall module 120 is hung on the steel structure module 110 by the hoisting equipment to complete the installation. Thus the steel structure module 110 and the curtain wall module 120 of the modular curtain wall are fully prefabricated.

In this embodiment, as shown in FIGS. 6 to 11, the steel structure module 110 includes a steel structure body and a mount 111. The steel structure body can be a container. This embodiment is exemplarily illustrated with the curtain wall module 120 being hung on the outer surface of the end wall of the container (the surface of the end wall facing the outside of the container). It is to be understood that the curtain wall module 120 may also be disposed on the outer surface of the side wall of the container. The positional relationships and directions herein are interpreted based on the curtain wall module 120 being hung on the end wall of the container.

Figure 6:
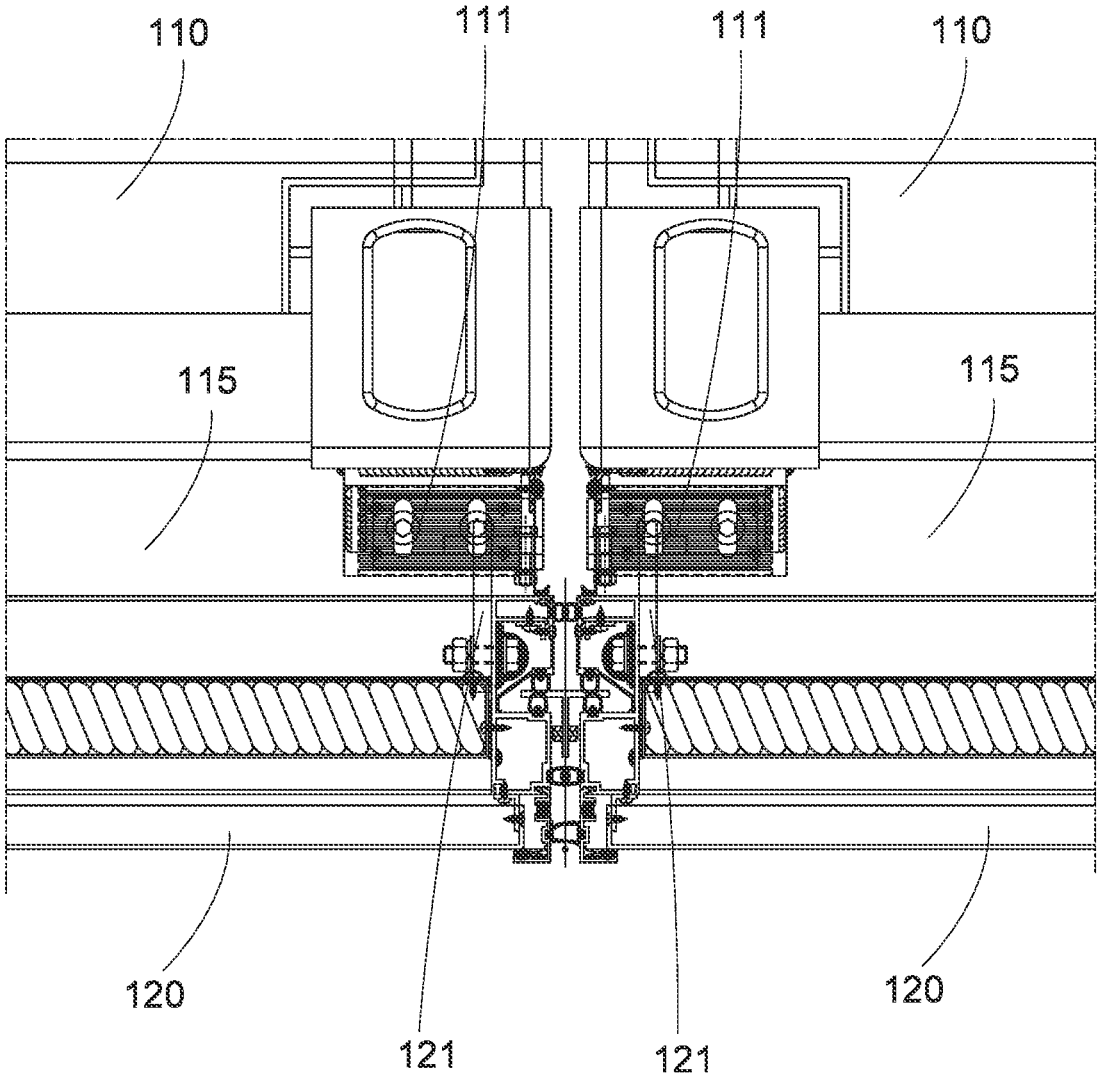
FIG. 6 is a partial schematic diagram showing that two steel structure modules and two curtain wall modules of the lower layer of the modular curtain wall of FIG. 1 are connected together (in which the hook and the mount are shown)
Figure 7:
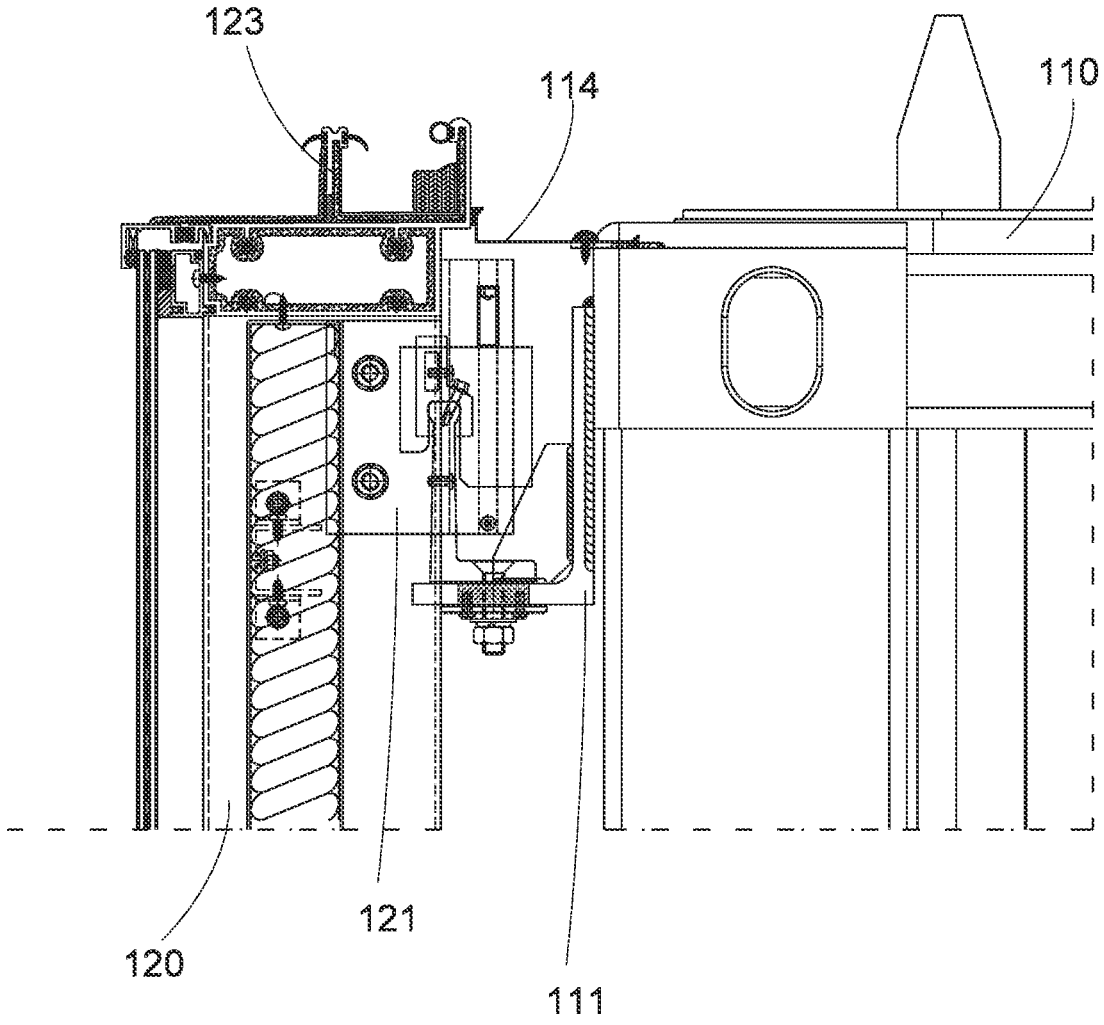
FIG. 7 is a partial schematic diagram showing the top of the steel structure module and the curtain wall module of the lower layer of the modular curtain wall of FIG. 2 that are connected together.
Figure 8:
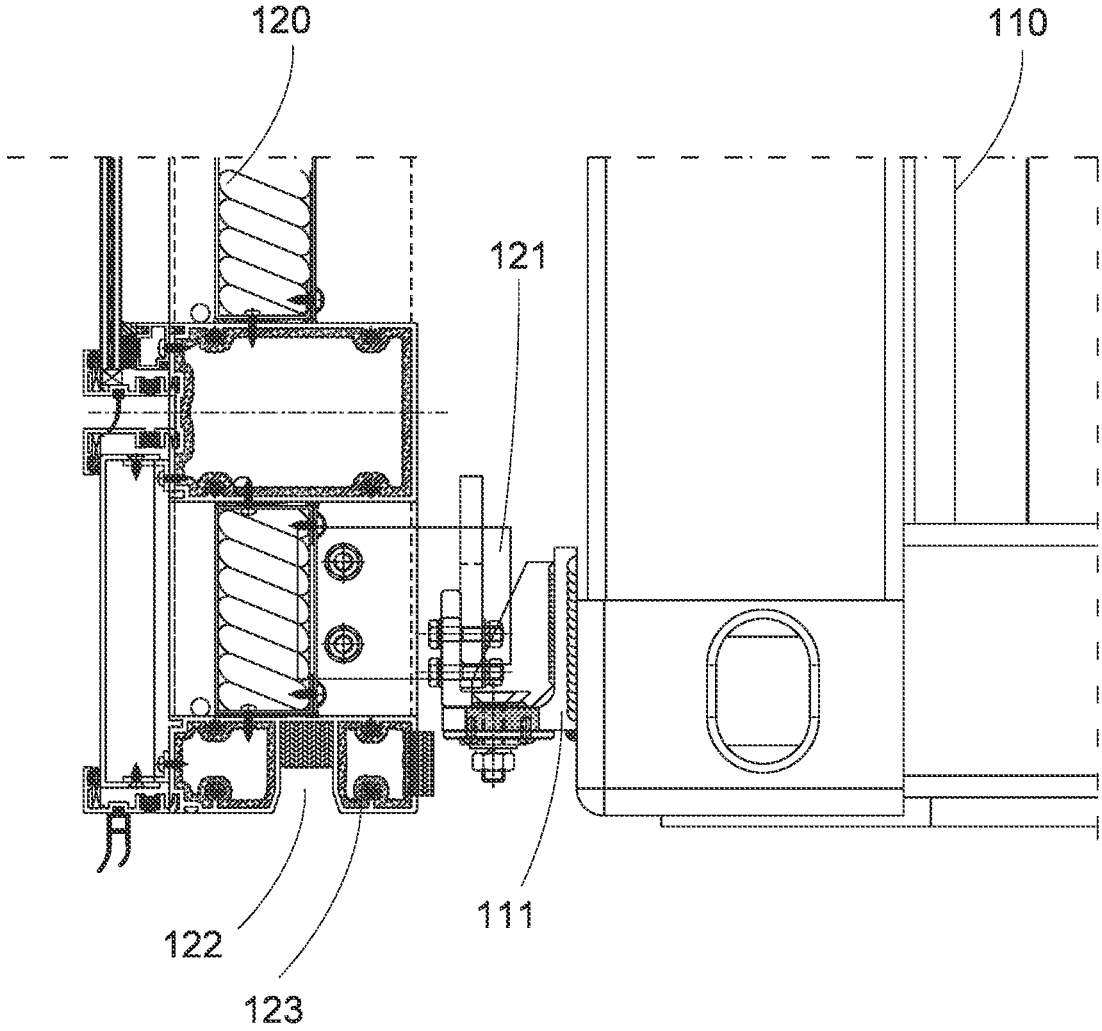
FIG. 8 is a partial schematic diagram showing the bottom of the steel structure module and the curtain wall module of the upper layer of the modular curtain wall of FIG. 2 that are connected together.
Figure 9:
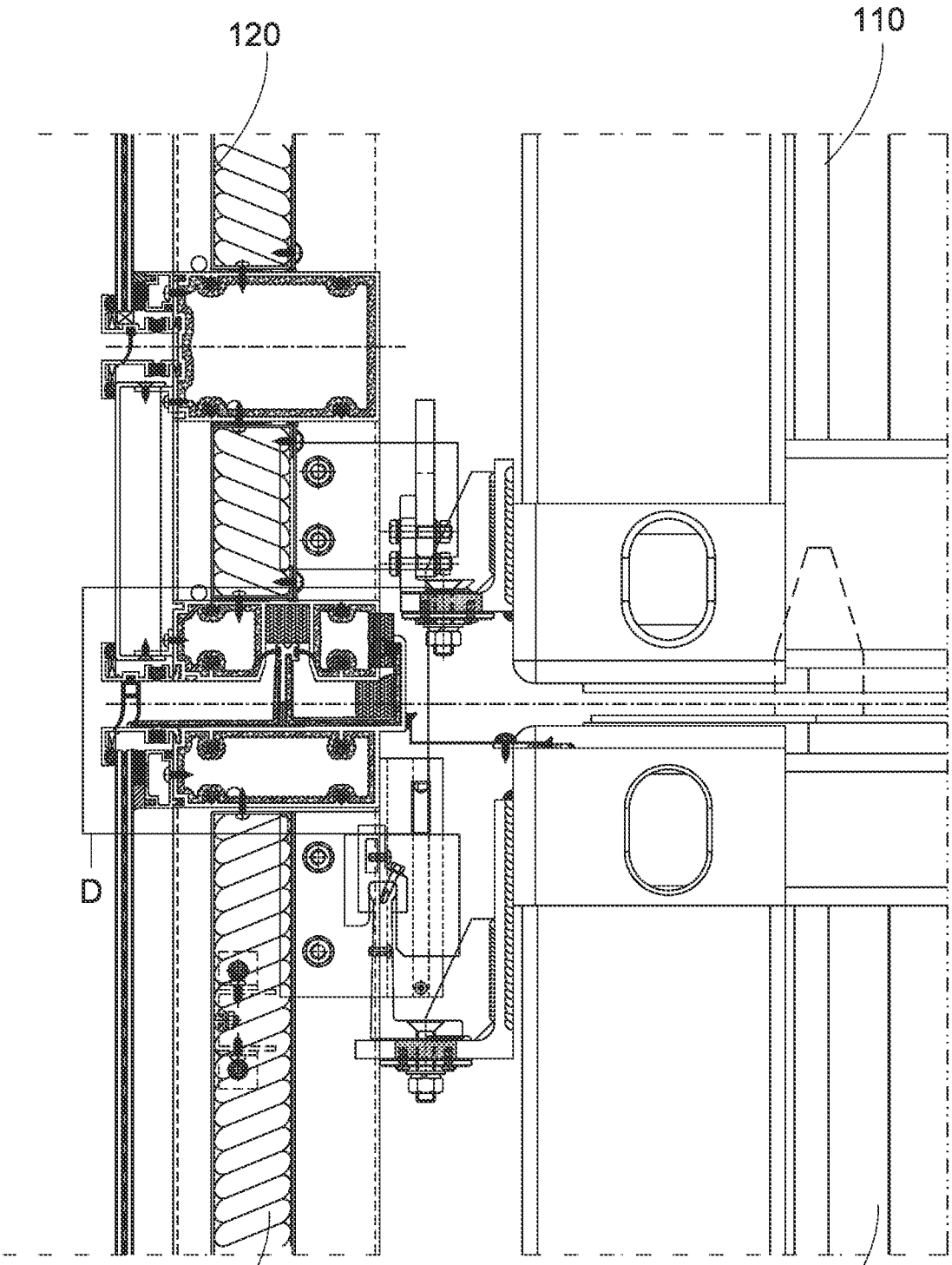
FIG. 9 is a partial schematic diagram showing that the steel structure module and the top of the curtain wall module in the lower layer are connected together with the steel structure module and the bottom of the curtain wall module in the upper layer of the modular curtain wall of FIG. 2.
Figure 10:
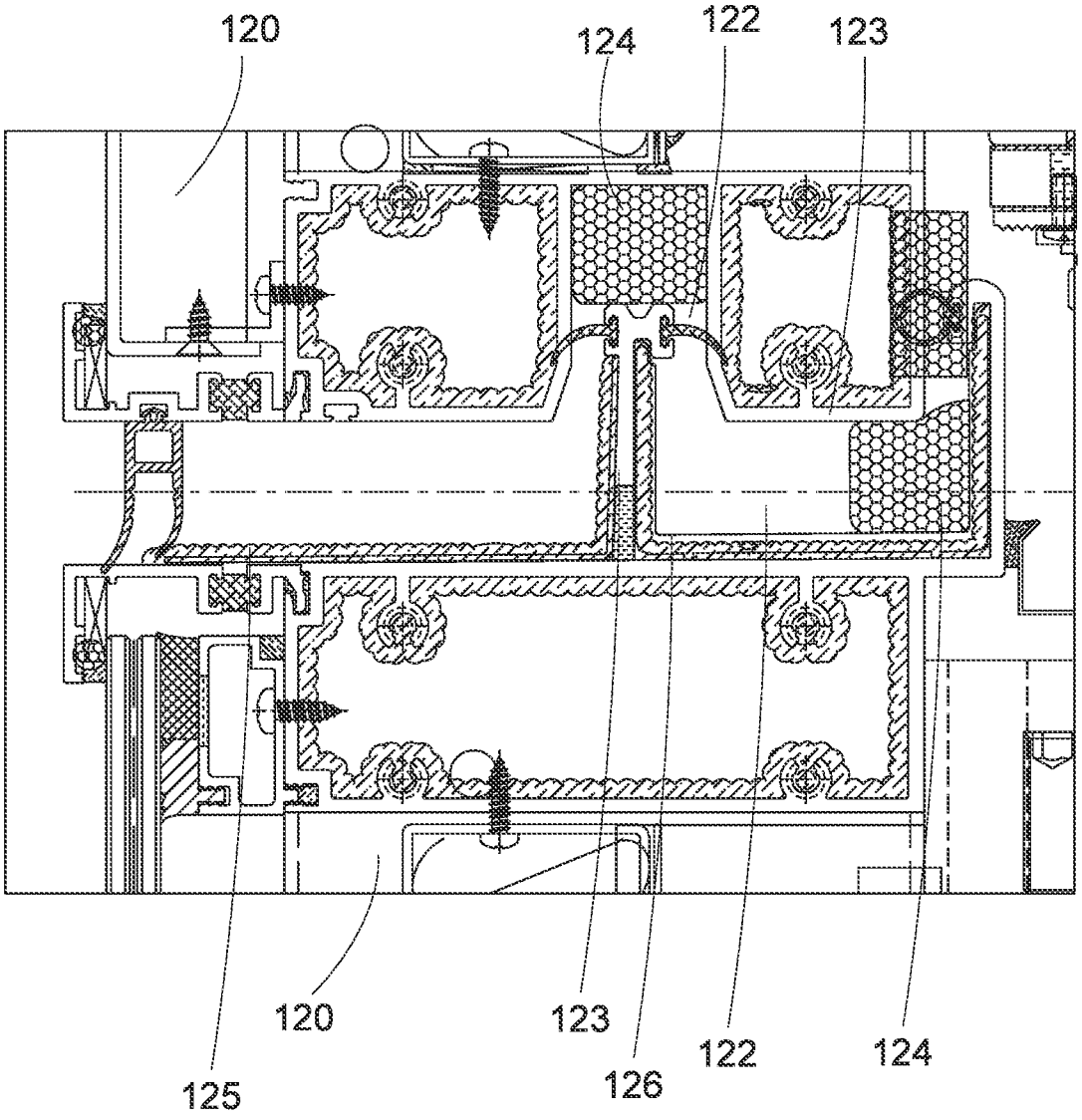
FIG. 10 is a partial enlarged schematic diagram of D zone in FIG. 9.
Figure 11:
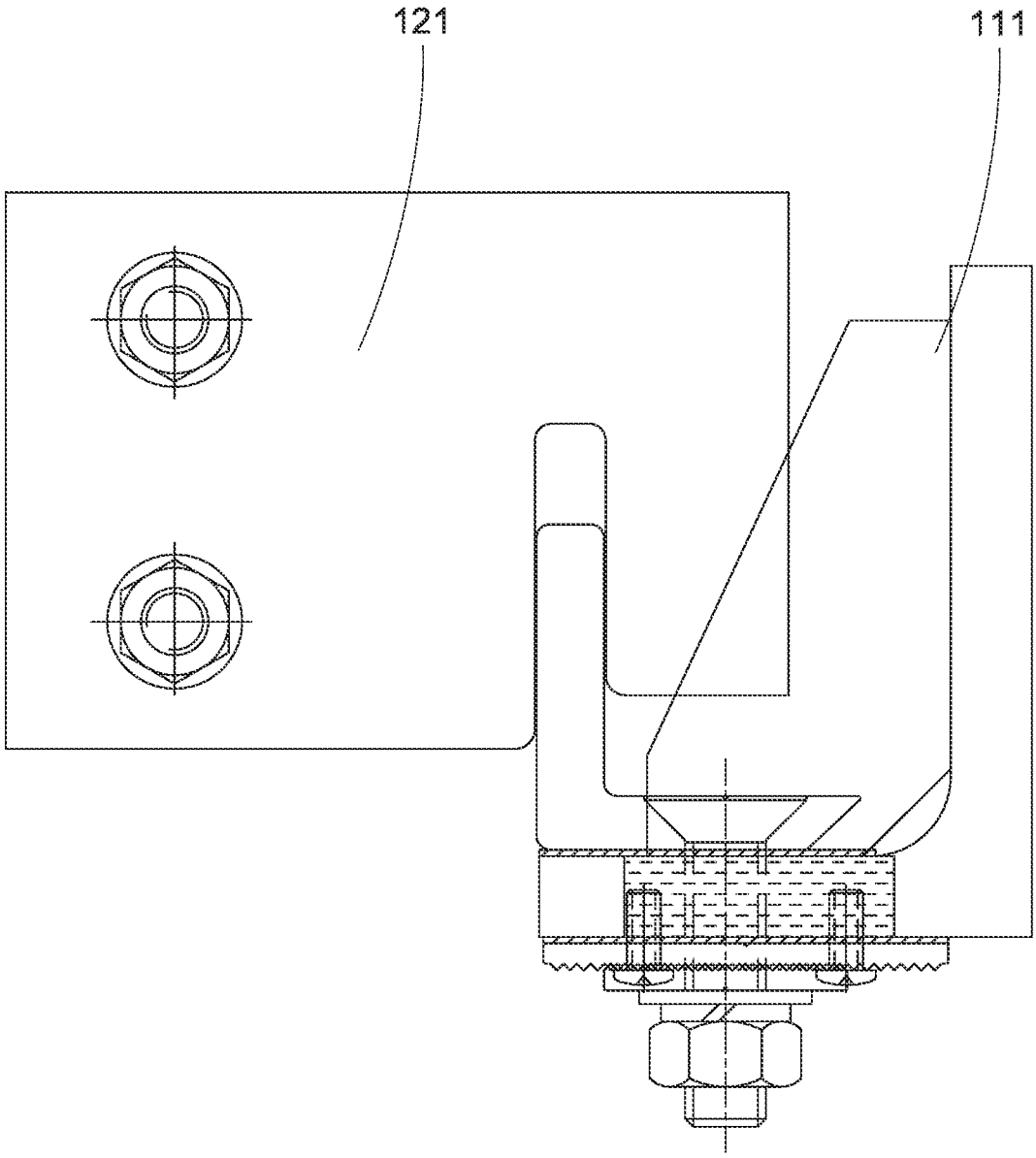
FIG. 11 is a schematic diagram of FIG. 6 showing that the hook and the mount are connected together.
Figure 12:
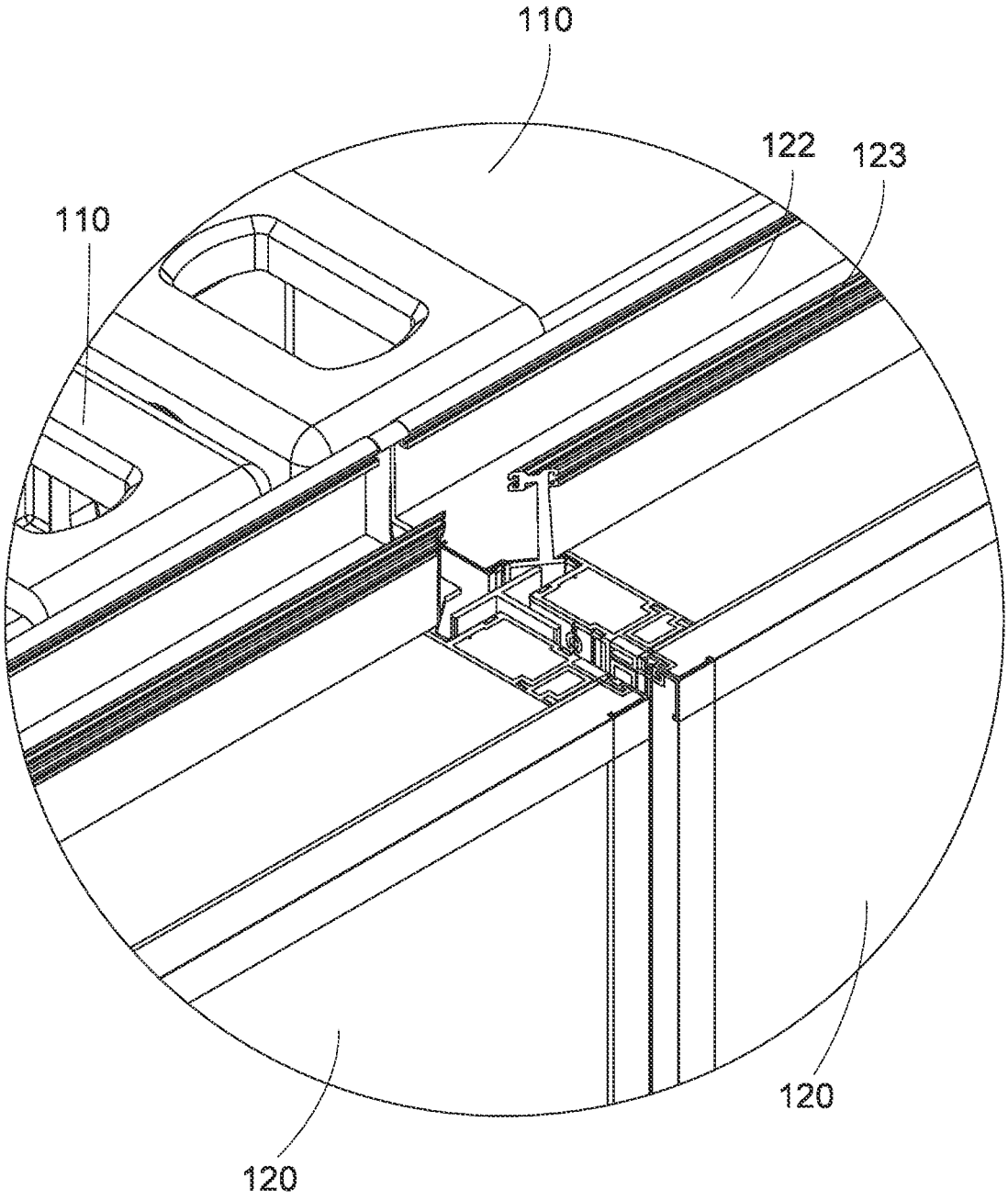
FIG. 12 is a partial enlarged schematic diagram of A zone in FIG. 1.
Figure 13:
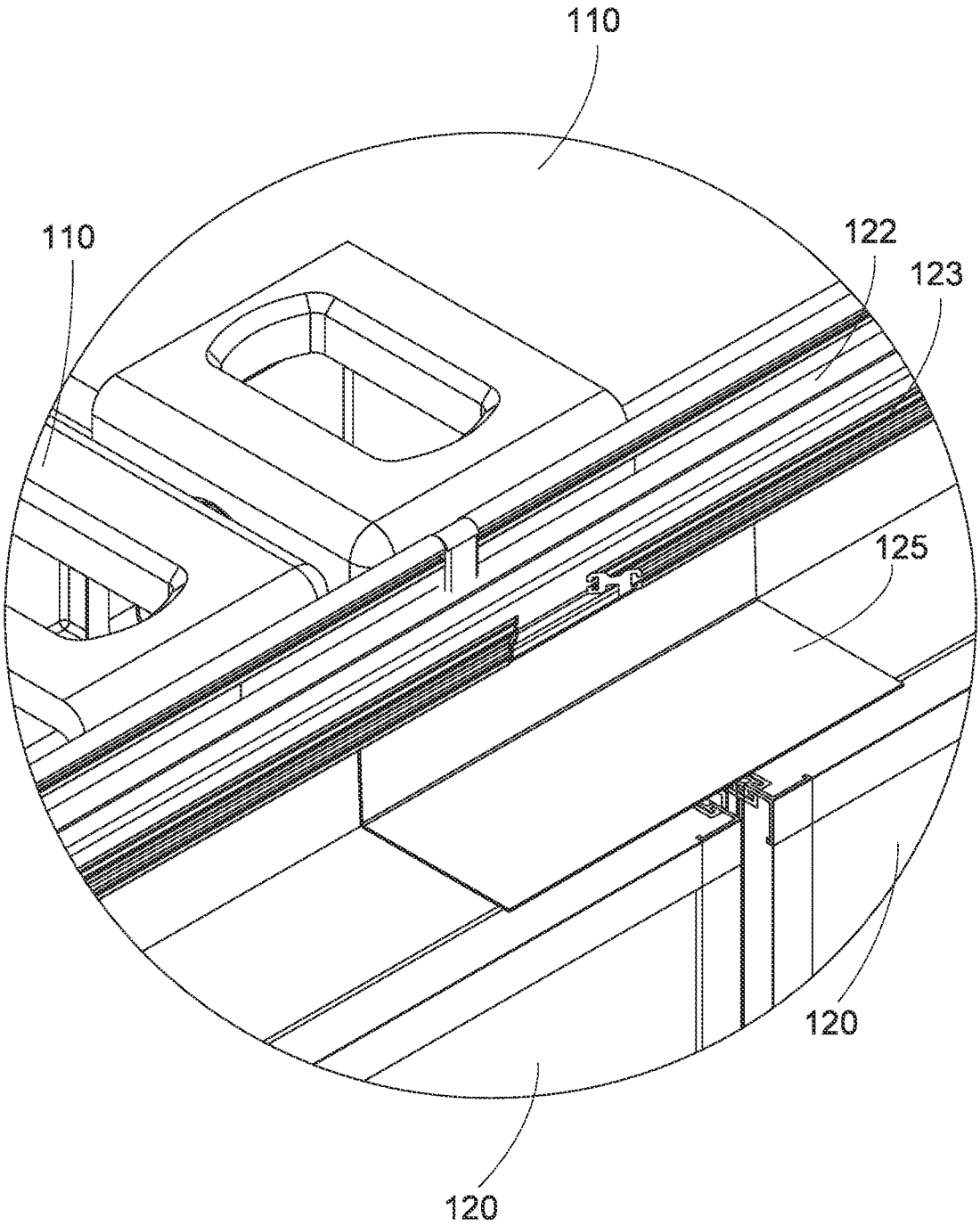
FIG. 13 is a partial enlarged schematic diagram of B zone in FIG. 2 (in which the waterproof glue piece is shown)

A plurality of mounts 111 are provided on the outer surface of the end wall of the container. The mount 111 can be disposed on the top end beam, the bottom end beam, the wall, and the post of the end wall of the container. The mount 111 can include a first mount, a second mount, a mount bolt, and a mount nut. The first mount and the second mount are both L-shaped structures. The vertical arm of the first mount can be welded to the end wall of the container. The transverse arm of the first mount is provided with an adjustment elongated hole (as shown in FIG. 6) extending along a length direction of the container (the front-back direction). The transverse arm of the second mount is provided with a mounting hole corresponding to the adjustment elongated hole. The transverse arm of the second mount is rest on the transverse arm of the first mount. The vertical arm of the second mount is positioned on the side where the free end of the transverse arm of the first mount is positioned. The mount bolt passes through the mounting hole of the second mount and the elongated mounting hole of the first mount and then is coupled to the mount nut, so as to connect the second mount to the first mount. In this way, the relative position between the first mount and the second mount can be adjusted in the length direction of the container, thereby adjusting the relative position between the curtain wall module 120 and the container in the length direction of the container.

The curtain wall module 120 includes a curtain wall body and a hook 121. The curtain wall body includes wall panels and a curtain wall frame. When the curtain wall module 120 is hung on the container, the plane on which the wall panels are positioned is substantially parallel to the plane on which the end walls of the container are positioned. The curtain wall frame may include a rectangular frame composed of a curtain wall post, a top beam of the curtain wall, and a bottom beam of the curtain wall. The wall panels are disposed at the outer surface of the curtain wall frame, which is the end surface of the curtain wall frame away from the container when the curtain wall module 120 is hung on the container. It should be noted that one curtain wall frame can be provided with more than one wall panels. There can be intervals between adjacent wall panels, or adjacent wall panels can be spliced together. Or one curtain wall frame is provided with one wall panel only. One or more curtain wall module(s) 120 can be hung on the end wall of a container, and those skilled in the art can set it as needed.

A hook 121 is provided to the curtain wall module 120. The hook 121 is disposed corresponding to the mount 111. The hook 121 includes a connecting portion and a hooking portion. The hooking portion may be a flat plate. When the curtain wall module 120 is hung on the container, the plane where the flat plate is positioned is substantially parallel to the plane where the side wall of the container is positioned. An end of the hooking portion is provided with a U-shaped opening corresponding to the vertical arm of the second mount. The U-shaped opening constitutes the notch of the hooking portion. The U-shaped opening faces downward. The U-shaped opening runs throughout the hooking portion in the width direction of the container.

The hooking portion is provided with a first positioning hole in communication with the inner space of the opening of the U-shaped opening. The curtain wall module 120 further includes a first positioning bolt (not shown) and a second positioning bolt (not shown). The first positioning bolt is threadedly connected to the first positioning hole. In this way, the free end of the vertical arm of the second mount extends into the U-shaped opening, and therefore the hook 121 can be hung on the mount 111. Here, the hooking portion can slide along the width direction of the container. The first positioning bolt connected to the first positioning hole is tightened so that the first positioning bolt abuts against the vertical arm of the second mount in the U-shaped opening, and the hooking portion can be fixed to the vertical arm of the second mount.

In this embodiment, it is possible to adjust the relative position between the hooking portion and the vertical arm of the second mount in the width direction of the container, thereby adjusting the relative position between the container and the curtain wall module 120 in the width direction (the left-right direction) of the container.

In this embodiment, one end of the connecting portion is connected to the post of the curtain wall module 120 (via welded connection or bolted connection). The other end of the connecting portion is provided with a sliding groove (not shown) extending along the height direction of the container. The other end of the hooking portion is received within the sliding groove and can slide along the sliding groove. The connecting portion is provided with a second positioning hole in communication with the sliding groove. The second positioning bolt is threadedly connected to the second positioning hole. In this way, the second positioning bolt connected to the second positioning hole is tightened so that the second positioning bolt abuts against the part of the hooking portion within the sliding groove, and the hooking portion can be fixed to the connecting portion.

In this embodiment, it is possible to adjust the relative position between the hooking portion and the connecting portion in the height direction of the container, thereby adjusting the relative position between the container and the curtain wall module 120 in the height direction (the up-down direction) of the container.

It can be understood that in other embodiments, in the above-mentioned width direction, length direction, and height direction, the position of the entirety of mount 111 is adjustable on the end wall of the container, and the position of the entirety of hook 121 is adjustable on the curtain wall body. This also makes it possible to adjust the position of the container relative to the curtain wall body in the above-mentioned width direction, length direction, and height direction.

In this embodiment, as shown in FIGS. 7 to 10, 12, and 13, the upper surface of the curtain wall top beam of the curtain wall frame is provided with a first protrusion and a second protrusion. The first protrusion and the second protrusion extend in the width direction of the container. The first protrusion and the second protrusion are spaced apart in the length direction of the container. The first protrusion constitutes an installing protrusion 123 at the top of the curtain wall body. The first protrusion, the second protrusion, and the curtain wall top beam of the curtain wall frame define an installing groove 122 of the curtain wall body.

The lower surface of the curtain wall bottom beam of the curtain wall frame is provided with a third protrusion and a fourth protrusion. The third protrusion and the fourth protrusion extend in the left-right direction. The third protrusion and the fourth protrusion are spaced apart along the length direction of the container. The fourth protrusion is corresponding to the installing groove 122 that is defined by the first protrusion, the second protrusion, and the curtain wall top beam of the curtain wall frame. The fourth protrusion constitutes the installing protrusion 123 at the bottom of the curtain wall body. The third protrusion, the fourth protrusion, and the curtain wall bottom beam of the curtain wall frame define the installing groove 122 at the bottom of the curtain wall body. The installing groove 122, which is defined by the third protrusion, the fourth protrusion, and the curtain wall bottom beam of the curtain wall frame, is corresponding to the first protrusion. In other words, the position of the installing protrusion 123 at the bottom of the curtain wall body corresponds to the position of the installing groove 122 at the top of the curtain wall body. The position of the installing groove 122 at the bottom of the curtain wall body corresponds to the position of the installing protrusion 123 at the top of the curtain wall body.

When a plurality of curtain wall modules 120 are stacked together, the installing protrusion 123 at the bottom of an upper curtain wall modules 120 inserts into the installing groove 122 at the top of a lower curtain wall modules 120 of the adjacent curtain wall modules 120 in the height direction of the container. The installing protrusion 123 at the top of the lower curtain wall modules 120 inserts into the installing groove 122 at the bottom of the upper curtain wall modules 120. Therefore, it is convenient for positioning the upper curtain wall modules 120, and the arrangement of the installing protrusion 123 and the installing groove 122 can increase strength of the connection between the curtain wall modules 120 that are stacked together.

In this embodiment, the installing protrusion 123 and the installing groove 122 at the top of the curtain wall body are arranged at intervals in the length direction of the container. The installing groove 122 and the installing protrusion 123 at the bottom of the curtain wall body are arranged at intervals in the length direction of the container. Therefore, in the curtain wall modules 120 that are stacked together, the installing protrusion 123 and the installing groove 122 at the joint of the adjacent curtain wall modules 120 are staggered with each other, which can further increase connection strength and waterproof performance of the curtain wall modules 120 that are stacked together.

In this embodiment, the curtain wall module 120 further includes an intermediate member 126. The end surface of the bottom of the intermediate member 126 is corresponding to the inner surface of the installing groove 122 defined by the first protrusion and the second protrusion of the curtain wall body and the curtain wall top beam of the curtain wall frame. The end surface of the top of the intermediate member 126 is corresponding to the lower surface of the above-mentioned fourth protrusion. The intermediate member 126 is disposed in the installing groove 122 that is defined by the first protrusion, the second protrusion, and the curtain wall top beam of the curtain wall frame. The end surface of the bottom of the intermediate member 126 faces towards the inner surface of the installing groove 122 that is defined by the first protrusion and the second protrusion of the curtain wall module 120 and the curtain wall top beam of the curtain wall frame. In this way, when a plurality of curtain wall modules 120 are stacked together, the top of the intermediate member 126 can avoid the lower surface of the fourth protrusion.

The intermediate member 126 is movably disposed in the installing groove 122 that is defined by the first protrusion, the second protrusion, and the curtain wall top beam of the curtain wall frame along the width direction of the container. In this way, when a plurality of curtain wall modules 120 are spliced along the width direction of the container, the intermediate member 126 can be moved so that the intermediate member 126 covers the part of the splicing gap between the top ends of the adjacent curtain wall modules 120 in the width direction of the container in the installing groove 122 that is defined by the first protrusion, the second protrusion, and the curtain wall top beam of the curtain wall frame, which increases the waterproofness.

In this embodiment, the curtain wall module 120 further includes a waterproof glue piece 125. When several curtain wall modules 120 are spliced along the width direction of the container, the waterproof glue piece 125 can be affixed on the top of the curtain wall body. The waterproof glue piece 125 is positioned outside the installing groove 122 that is defined by the first protrusion, the second protrusion, and the curtain wall top beam of the curtain wall frame. In the width direction of the container, the waterproof glue piece 125 covers the part of the top of the splicing gap between the adjacent curtain wall modules 120 outside the installing groove 122 to increase the waterproofness.

In this embodiment, the curtain wall module 120 further includes two second seals 124. The second seal 124 may be a sealing rubber strip. The two second seals 124 extend in the width direction of the container. One second seal 124 is disposed in the installing groove 122 defined by the first protrusion, the second protrusion, and the curtain wall top beam of the curtain wall frame. In this way, among the curtain wall modules 120 stacked together, the installing protrusion 123 at the bottom of the upper curtain wall module 120 squeezes the second seal 124 to press the second seal 124 into the installing groove 122 at the top of the lower curtain wall module 120. This second seal 124 seals the gap between the installing protrusion 123 at the bottom of the upper curtain wall module 120 and the installing groove 122 at the top of the lower curtain wall module 120.

In this embodiment, the other second seal 124 is disposed in the installing groove 122 defined by the third protrusion, the fourth protrusion, and the curtain wall bottom beam of the curtain wall frame. In this way, among the curtain wall modules 120 stacked together, the installing groove 122 at the bottom of the upper curtain wall module 120 squeezes the second seal 124 to press the second seal 124 against the installing protrusion 123 at the top of the lower curtain wall module 120. This second seal 124 seals the gap between the installing groove 122 at the bottom of the upper curtain wall module 120 and the installing protrusion 123 at the top of the lower curtain wall module 120. As a result, a dual seal is formed at the splicing gap of the stacked curtain walls, providing a better sealing effect.

In this embodiment, as shown in FIGS. 3 to 6, both ends of the curtain wall modules 120 are provided with a third seal 127 in the width direction of the container. In this way, when the curtain wall modules 120 are spliced in the left-right direction, the third seals 127 at the splicing gap of the adjacent curtain wall modules 120 abut against each other to seal the splicing gap between the adjacent curtain wall modules 120 in the width direction of the container.

Figure 5:
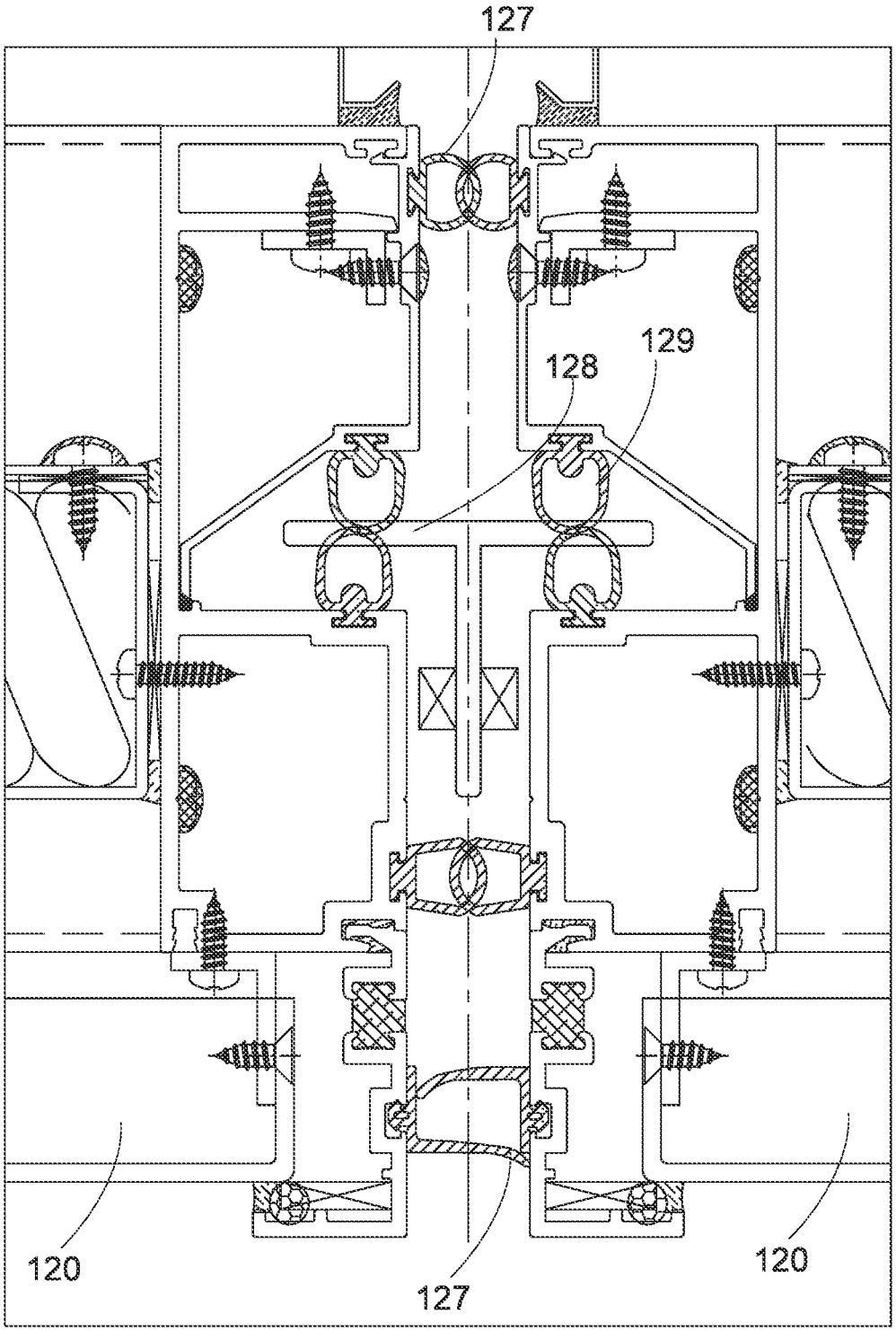
FIG. 5 is a partial schematic diagram of C zone in FIG. 4.

In this embodiment, the modular curtain wall further includes a first waterproof member 128. The first waterproof member 128 may be a bar-shaped structure with a T-shaped structure in cross section. The T-shaped structure includes transverse arm and vertical arm. In the width direction of the container, both ends of the curtain wall module 120 are provided with a first seal 129. When the curtain wall modules 120 are spliced in the width direction of the container, the adjacent curtain wall modules 120 at their joints enclose a T-shaped space corresponding to the T-shaped structure of the first waterproof member 128. The first seal 129 is provided in the lateral space of the T-shaped space. The T-shaped structure runs through the T-shaped space. The first seals 129 at the end of the curtain wall module 120 abut on both sides of the transverse arm of the T-shaped structure in the length direction of the container. As shown in FIG. 5, in the width direction of the container, the first seal 129 abuts against the transverse arm of the T-shaped structure on both sides of the vertical arm of the T-shaped structure.

In this embodiment, when the curtain wall modules 120 are spliced in the width direction of the container, the first waterproof member 128 is disposed in the splicing gap between the adjacent curtain wall modules 120, and the first seals 129 abut against the first waterproof member 128. In this way, the first seals 129 and the first waterproof member 128 cooperate to seal the splicing gap between the adjacent curtain wall modules 120.

In this embodiment, as shown in FIG. 5, the third seal 127, the T-shaped structure, and the first seal 129 form a multi-layer sealing structure in the splicing gap between the adjacent curtain wall modules 120, thereby improving the sealing effect on the splicing gap between the adjacent curtain wall modules 120.

Figure 14:
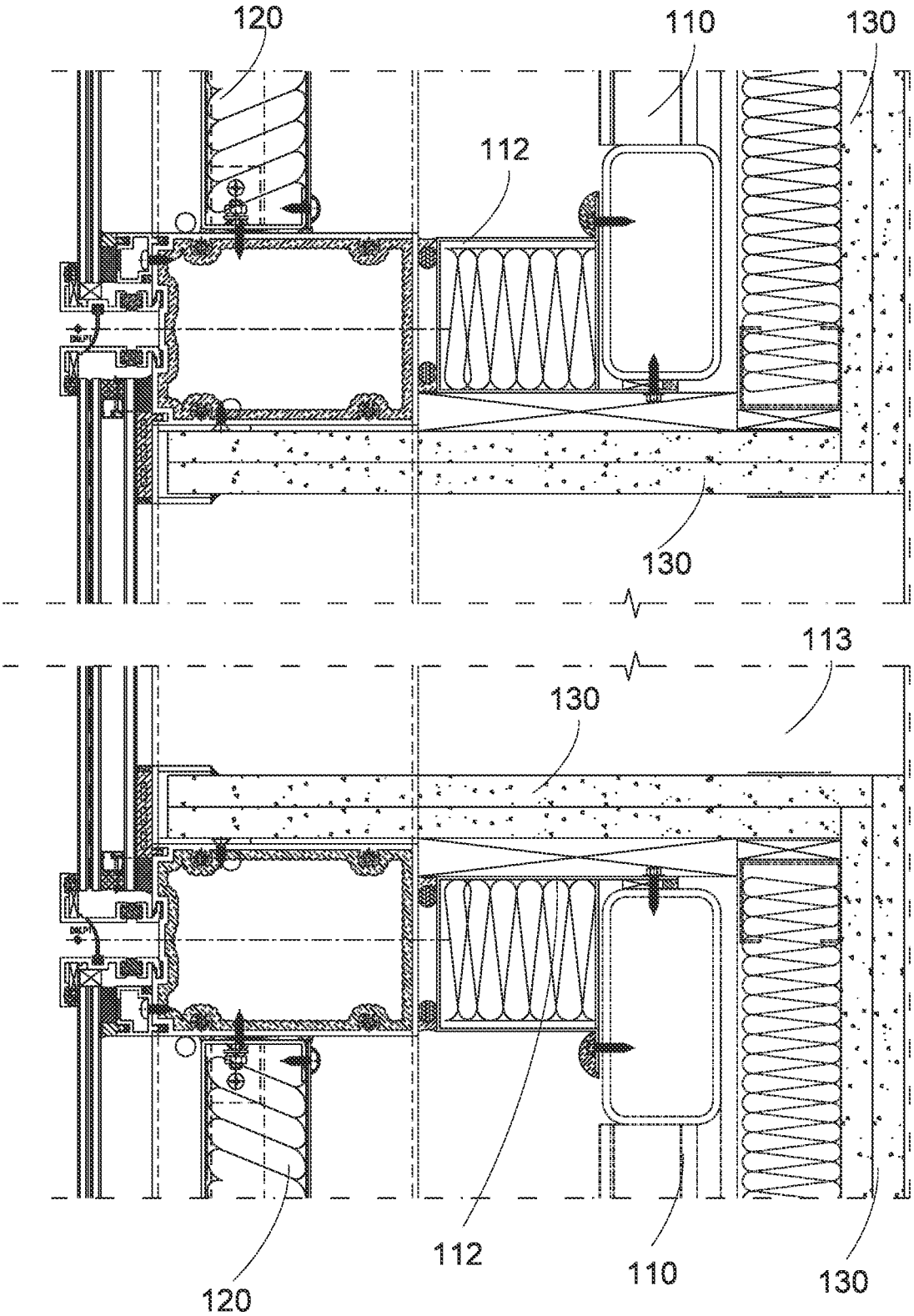
FIG. 14 is a schematic diagram showing the channel, fireproof board, and frame of the modular curtain wall of FIG. 1.

In this embodiment, as shown in FIG. 14, in the length direction of the container, there is a gap between the end wall of the container facing the curtain wall module 120 and the curtain wall body. The end wall of the container facing the curtain wall module 120 is provided with a rectangular opening in communication with the internal space of the container. The steel structure module 110 also includes a frame 112. The frame 112 can be molded from galvanized steel sheet. The frame 112 is disposed in the gap between the end wall of the container facing the curtain wall module 120 and the curtain wall body. The frame 112 can be a substantially cuboid structure. In the length direction of the container, the cross-sectional shape of the frame 112 corresponds to the shape of the rectangular opening of the container. The frame 112 is provided with a first internal through hole extending along the length direction of the container. The part of the frame 112 surrounding the first internal through hole is a hollow structure. The hollow structure is filled with fireproof sponge. The frame 112 is disposed at the rectangular opening of the container.

In the length direction of the container, one end of the frame 112 is connected to the door frame surrounding the opening of the container with screws. The other end of the frame 112 abuts against the adjacent posts of the curtain wall frame through the seal (here, there are vents between the adjacent posts that abut against the frame 112). The first internal through hole of the frame 112 communicates with the opening of the container. In this way, the rectangular opening of the container, the first internal through hole of the frame 112, and the posts abutting the frame 112 define a channel 113. The channel 113 communicates with the internal space of the container and the aforesaid vent. The channel 113 can be used for ventilation.

In this embodiment, the inner surface of the rectangular opening of the container, the inner surface of the first internal through hole of the frame 112, the inner surface of the post enclosing and defining the channel 113, and the inner surface of the container are all provided with fireproof boards 130. Therefore, the fireproof layer formed by the fireproof boards 130 can increase the fireproof grade of the modular curtain wall. It can be understood that the inner surface of the rectangular opening of the container, the inner surface of the first internal through hole of the frame, the inner surface of the post enclosing and defining the channel 113, and the inner surface of the container can also be coated with fireproof materials to form fireproof layers. Preferably, the fireproof boards 130 have two layers, thereby further increasing the fireproof grade of the modular curtain wall.

Figure 1:
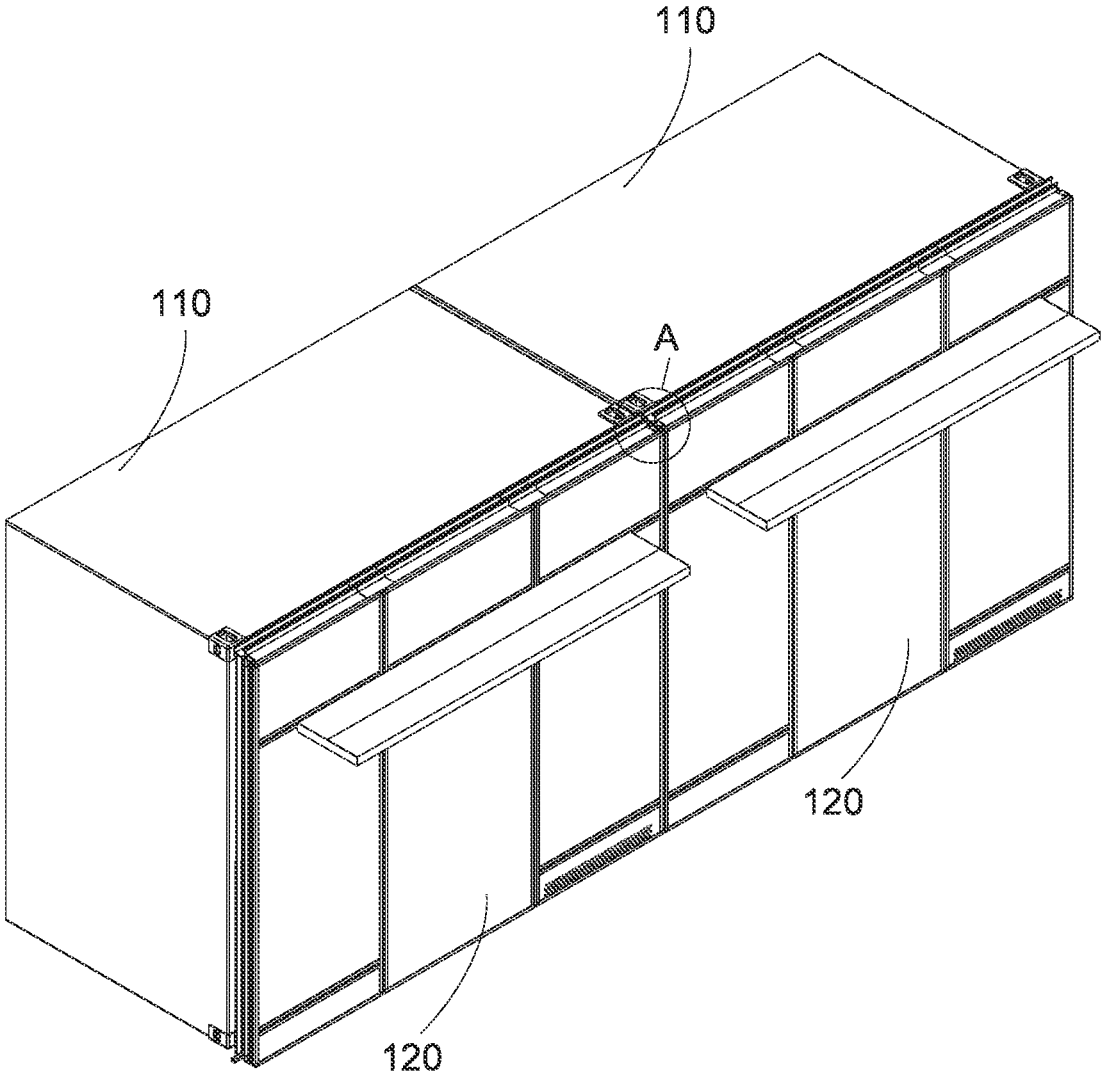
FIG. 1 is an overall schematic diagram of a modular curtain wall according to a first preferred embodiment of the present disclosure (which shows the lower layer of the modular curtain wall, including two steel structure modules and two curtain wall modules)
Figure 2:
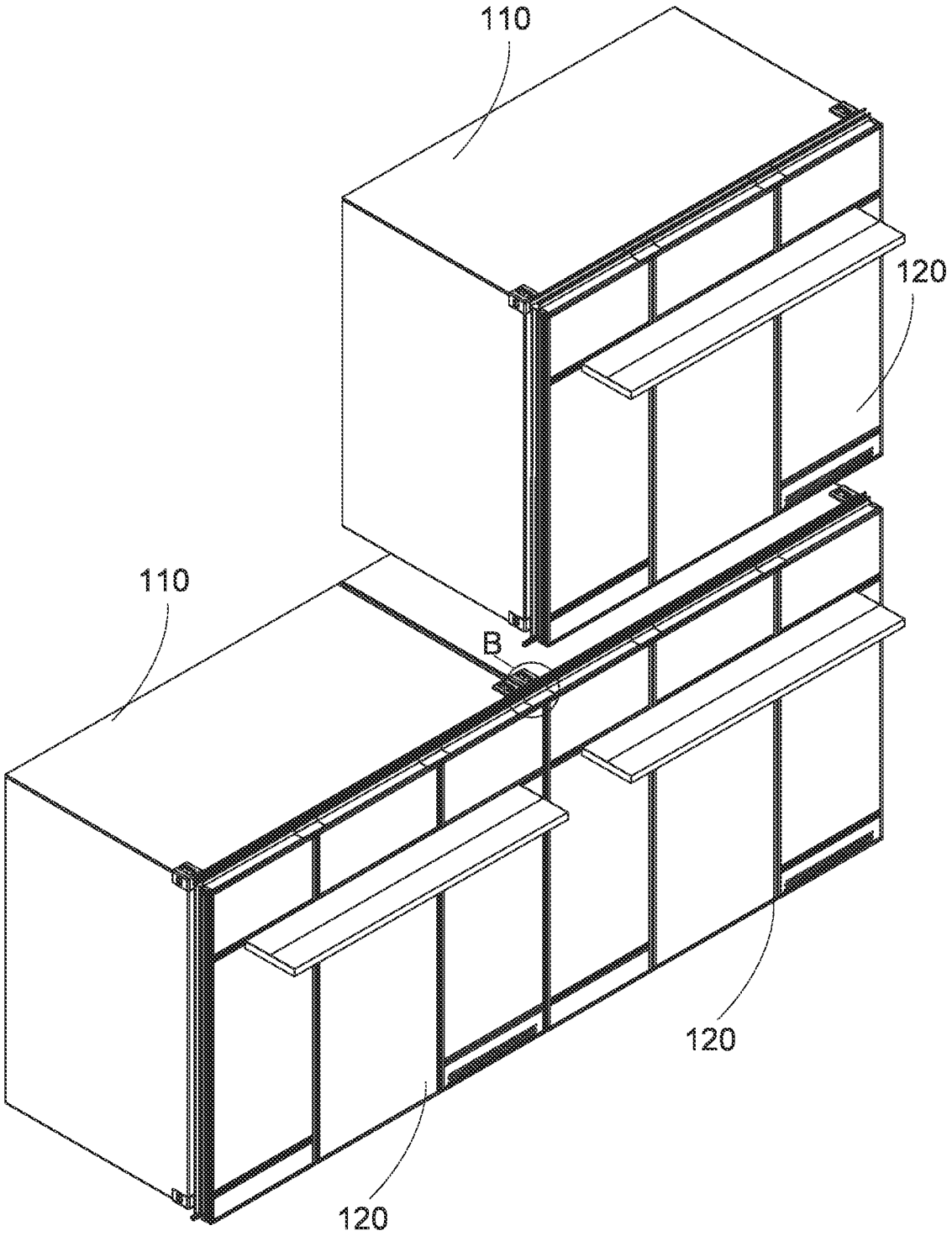
FIG. 2 is an overall schematic diagram of the modular curtain wall of FIG. 1 (which shows the lower and upper layers of the modular curtain wall, including three steel structure modules and three curtain wall modules)
Figure 3:
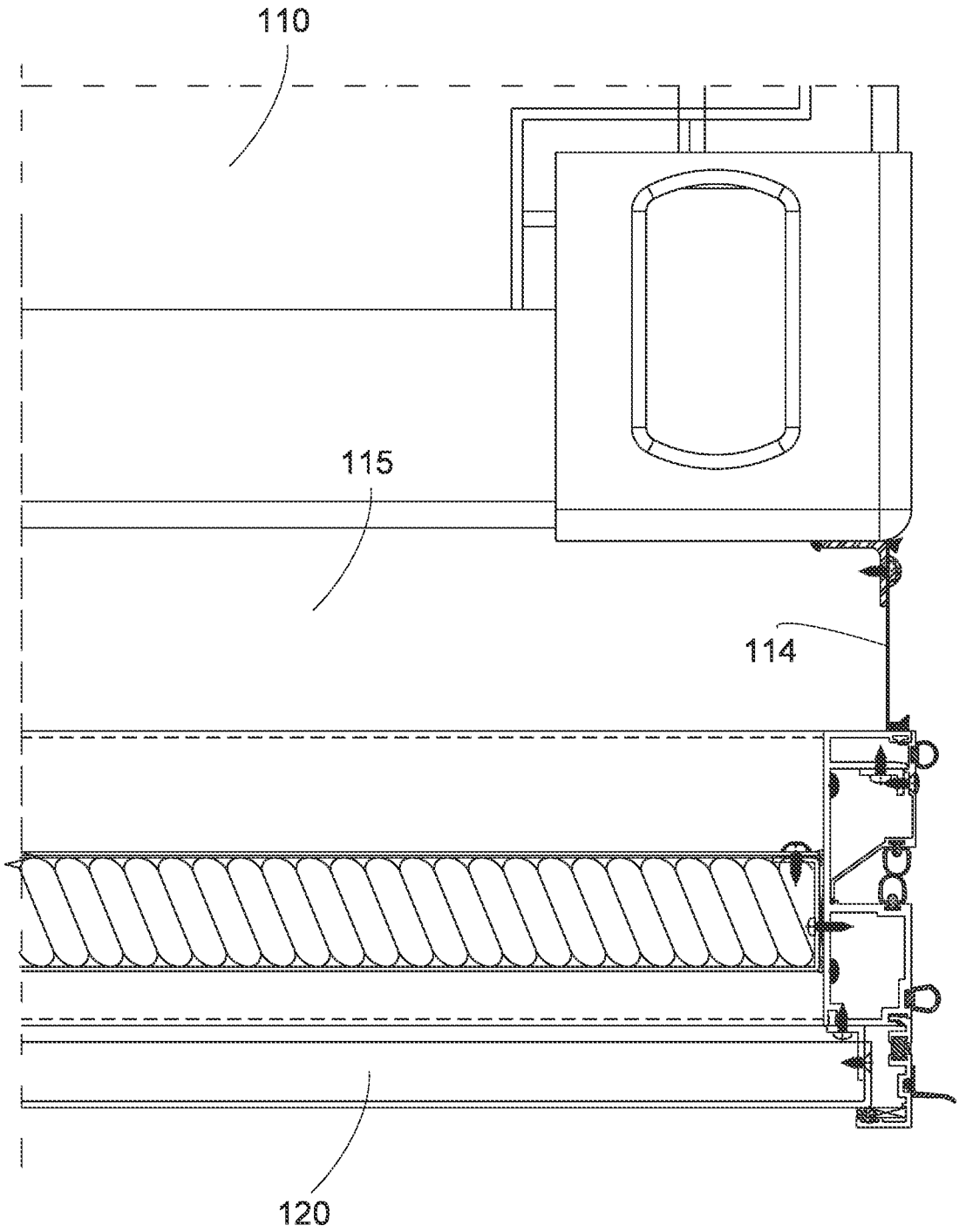
FIG. 3 is a partial schematic diagram showing that the steel structure module and the curtain wall module of the lower layer of the modular curtain wall of FIG. 1 are connected together.
Figure 4:
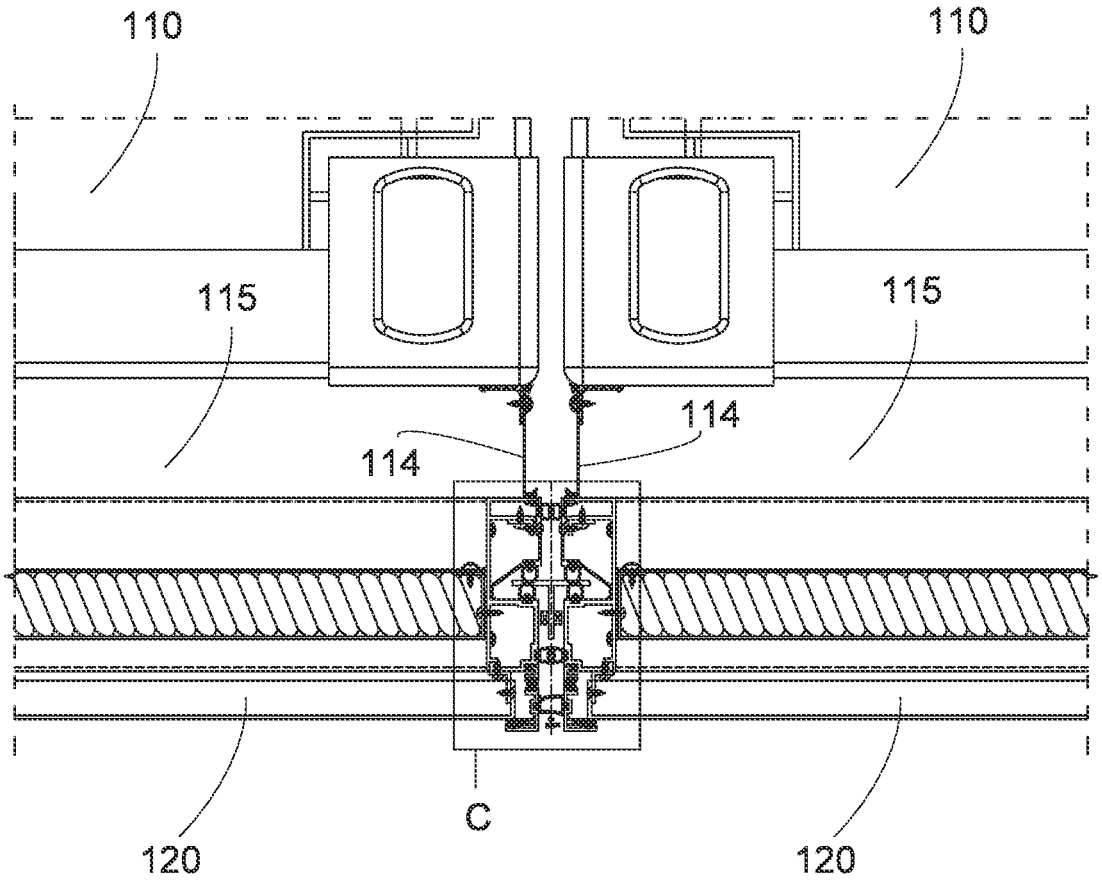
FIG. 4 is a partial schematic diagram showing that two steel structure modules and two curtain wall modules of the lower layer of the modular curtain wall of FIG. 1 are connected together.

In this embodiment, as shown in FIGS. 3 and 4, the steel structure module further includes a second waterproof member 114. The second waterproof member 114 can be molded from a galvanized sheet. The second waterproof member 114 is a cuboid structure. The outer contour of the cross section of the second waterproof member 114 is substantially the same as the contour of the periphery of the container's end wall. The cross section of the second waterproof member 114 is perpendicular to the length direction of the container. The second waterproof member 114 is provided with a second internal through hole 115. The second internal through hole 115 extends along the length direction of the container. The second internal through hole 115 runs throughout the second waterproof member 114. The second internal through hole 115 extends from the first end to the second end of the second waterproof member 114. Support members are provided to each of the posts, the top end beam, and the bottom end beam on the end surface of the container where the curtain wall module 120 is provided. The support members can be angle steel. The angle steel can be welded to the container. The angle steel is connected to the first end of the second waterproof member 114 by screws. The second end of the second waterproof member 114 abuts against the curtain wall frame of the curtain wall module 120.

At least part of the mount 111 is positioned in the second internal through hole 115 of the second waterproof member 114. When the curtain wall module 120 is hung on the container, the hook 121 of the curtain wall module 120 inserts from the second end of the second waterproof member 114 into the second internal through hole 115 and then is hung on the mount 111. The frame 112 can be positioned in the second internal through hole 115. Thus, the gap between the curtain wall frame and the end wall of the container can be sealed. A waterproof glue is provided on the abutting surfaces of the second waterproof member 114 and the curtain wall frame to further improve the waterproof performance.

In this embodiment, disposing the mount 111 and the hook 121 makes it possible that the curtain wall module 120 can be hung on the steel structure module 110 by a hoisting equipment, and that the relative position between the curtain wall module 120 and the steel structure module 110 is adjustable in the front-back direction, left-right direction, and up-down direction of the steel structure module 110, which is convenient to adjust the position between the curtain wall module 120 and the steel structure module 110. The first seal 129 and the first waterproof member 128 cooperate to seal the splicing gap between the adjacent curtain wall modules 120. As such, components of the steel structure module 110, components of the curtain wall module 120, and the first waterproof member 128 can be manufactured in the manufacturing plant, and the steel structure module 110 and the curtain wall module 120 can be pre-assembled. Then, the first waterproof member 128, the assembled steel structure module 110, and the assembled curtain wall module 120 are transported to a site to be installed and are installed by a hoisting equipment. This abandons the need of dealing with the joints, and therefore the need to build scaffolding and other safety maintenance facilities on site, which thereby shortens the construction period, reduces the construction cost, and achieves the full prefabrication of the steel structure module 110 and the curtain wall module 120 of the modular curtain wall, making installing convenient.

The present disclosure also provides an installing method of a modular curtain wall. The installing method is used to install the aforesaid modular curtain wall, and the installing method includes:

completing the manufacturing of components of the steel structure module 110, components of the curtain wall module 120, and the first waterproof member 128, and completing the assembly of the steel structure module 110 and the curtain wall module 120, wherein the components of the steel structure module 110, the components of the curtain wall module 120, and the first waterproof member 128 can be manufactured in the corresponding manufacturing plant, where the steel structure module 110 and the curtain wall module 120 are assembled;

transporting the steel structure module 110, the curtain wall module 120, and the first waterproof member 128 to a site on which the modular curtain wall is to be installed;

fixing the steel structure module 110;

hanging the hook 121 of the curtain wall module 120 on the mount 111 of the steel structure module 110;

wherein, the first waterproof member 128 is inserted into the splicing gap along the width direction of the container when the two adjacent curtain wall modules 120 of each layer of modular curtain wall are spliced.

In this embodiment, the installing method is used to install the aforesaid modular curtain wall. Disposing the mount 111 and the hook 121 makes it possible that the curtain wall module 120 can be hung on the steel structure module 110 by a hoisting equipment, and that the relative position between the curtain wall module 120 and the steel structure module 110 is adjustable in the front-back direction, left-right direction, and up-down direction of the steel structure module 110, which is convenient to adjust the position between the curtain wall module 120 and the steel structure module 110. The first seal 129 and the first waterproof member 128 cooperate to seal the splicing gap between the adjacent curtain wall modules 120. As such, components of the steel structure module 110, components of the curtain wall module 120, and the first waterproof member 128 can be manufactured in the manufacturing plant, and the steel structure module 110 and the curtain wall module 120 can be pre-assembled. Then, the first waterproof member 128, the assembled steel structure module 110, and the assembled curtain wall module 120 are transported to a site to be installed and are installed by a hoisting equipment. This abandons the need of dealing with the joints, and therefore the need to build scaffolding and other safety maintenance facilities on site, which thereby shortens the construction period, reduces the construction cost, and achieves the full prefabrication of the steel structure module 110 and the curtain wall module 120 of the modular curtain wall, making installing convenient.

Unless otherwise defined, the technical and scientific terms used herein have the same meanings as commonly understood by those skilled in the technical field of the present disclosure. The terms used herein are only for describing specific implementation purposes, and are not intended to limit the present disclosure. The terms such as "parts" appearing herein can mean a single part or a combination of multiple parts. Terms such as "mounting", "disposing" and the like appearing herein can mean that one component is directly attached to another component, or that one component is attached to another component through an intermediate component. A feature described in one embodiment herein can be applied to another embodiment alone or in combination with other features, unless the feature is not applicable in the other embodiment or otherwise stated.

The present disclosure has been described through the above-mentioned embodiments, but it should be understood that the above-mentioned embodiments are only for the purpose of illustration and description, and are not intended to limit the present disclosure to the scope of the described embodiments. Those skilled in the art can understand that more variations and modifications can be made according to the teachings of the present disclosure, and these variations and modifications fall within the protection scope claimed by the present disclosure.

What is claimed is:

1. A modular curtain wall, comprising:

a steel structure module including a steel structure body and a mount disposed on the steel structure body;

a curtain wall module including a curtain wall body, a hook disposed on the curtain wall body, and a first seal, the hook being corresponding to the mount, the hook being used to be hung on the mount such that the curtain wall body is fixed to the steel structure body, the first seal being disposed at left and right ends of the curtain wall body;

a first waterproof member being used to be disposed in a splicing gap between the adjacent curtain wall modules when at least two curtain wall modules are spliced in a left-right direction of the steel structure body, the first seal abutting against the first waterproof member to seal the splicing gap;

wherein when the hook is hung on the mount, the relative position between the curtain wall body and the steel structure body is adjustable in a front-back direction, the left-right direction, and an up-down direction of the steel structure body.

2. The modular curtain wall of claim 1, wherein the mount includes a first mount and a second mount, the first mount being connected to the steel structure body, the second mount being movably connected to the first mount along the front-back direction; wherein the hook includes a connecting portion and a hooking portion, the connecting portion being connected to the curtain wall body, the hooking portion being movably connected to the connecting portion along the up-down direction; wherein the hooking portion is provided with a notch with an opening facing downward and is movably hung on the second mount through the notch along the left-right direction.

3. The modular curtain wall of claim 1, wherein the curtain wall module further includes an installing groove and an installing protrusion corresponding to the installing groove, wherein the installing groove is disposed at the top of the curtain wall body and the installing protrusion is disposed at the bottom of the curtain wall body, or the installing groove is disposed at the bottom of the curtain wall body and the installing protrusion is disposed at the top of the curtain wall body.

4. The modular curtain wall of claim 3, wherein the curtain wall module further includes a second seal positioned in the installing groove.

5. The modular curtain wall of claim 3, wherein the curtain wall module further includes an intermediate member of a shape corresponding to the installing protrusion and the installing groove, the intermediate member being movably disposed in the installing groove along the left-right direction, the intermediate member being used to cover the part of the splicing gap between the adjacent curtain wall modules in the installing groove when at least two curtain wall modules are spliced along the left-right direction; and/or the curtain wall module further includes a waterproof glue piece used to cover the part of the splicing gap at the top of the curtain wall module when at least two curtain wall modules are spliced along the left-right direction, the waterproof glue piece being positioned outside the installing groove.

6. The modular curtain wall of claim 1, wherein the curtain wall module further includes a third seal positioned on an end surface of at least one of left and right ends of the curtain wall body, and when at least two curtain wall modules are spliced along the left-right direction, the third seal is positioned at the splicing gap between the adjacent curtain wall modules to seal the splicing gap between the adjacent curtain wall modules.

7. The modular curtain wall of claim 6, wherein a cross-section of the first waterproof member is a T-shaped structure, the first seal abutting on either side of both ends of a transverse arm of the T-shaped structure such that the third seal, the T-shaped structure, and the first seal form a multi-layer sealing structure at the splicing gap.

8. The modular curtain wall of claim 1, wherein there is a gap between the steel structure body and the curtain wall body, the steel structure body having an internal space and an opening in communication with the internal space; wherein the steel structure module further includes a frame disposed in the gap, one end of the frame being connected to the opening of the steel structure body, the other end of the frame being used to be sealingly connected with the curtain wall body, the frame and the opening defining a channel; wherein at least one of a surface forming the channel and a surface forming the internal space is provided with a fireproof layer.

9. The modular curtain wall of claim 1, wherein there is a gap between the steel structure body and the curtain wall body, and the steel structure module further includes a second waterproof member disposed in the gap, a first end of the second waterproof member being circumferentially connected to a surface of the steel structure body facing the curtain wall module, a second end of the second waterproof member being opposite to the first end and being used to be glued to the surface of the curtain wall body facing towards the surface of the steel structure body.

10. An installing method of a modular curtain wall, the installing method including:

assembling and providing:

a steel structure module including a steel structure body and a mount disposed on the steel structure body;

at least two curtain wall modules, each including a curtain wall body, a hook disposed on the curtain wall body, and a first seal, wherein the hook is corresponding to the mount and used to be hung on the mount such that the curtain wall body is fixed to the steel structure body, and the first seal is disposed at left and right ends of the curtain wall body; and a first waterproof member;

transporting all of the steel structure module, the curtain wall module, and the first waterproof member to a site where the modular curtain wall is to be installed;

fixedly disposing the steel structure module;

hanging the hook on the mount, such that, when the hook is hung on the mount, the relative position between the curtain wall body and the steel structure body is adjustable in a front-back direction, the left-right direction, and an up-down direction of the steel structure body; and inserting the first waterproof member into a splicing gap between two adjacent curtain wall modules of a layer of the modular curtain wall when the two adjacent curtain wall modules are spliced in the left-right direction of the steel structure body, such that the first seal abuts against the first waterproof member to seal the splicing gap.

11. The installing method of claim 10, wherein the step of assembling and providing the steel structure module, curtain wall modules, and first waterproof member includes:

configuring the mount to include a first mount and a second mount, the first mount being connected to the steel structure body, the second mount being movably connected to the first mount along the front-back direction; and configuring the hook to include a connecting portion and a hooking portion, the connecting portion being connected to the curtain wall body, the hooking portion being movably connected to the connecting portion along the up-down direction; wherein the hooking portion is provided with a notch with an opening facing downward and is movably hung on the second mount through the notch along the left-right direction.

12. The installing method of claim 10, wherein the step of assembling and providing the steel structure module, curtain wall modules, and first waterproof member includes:

configuring the curtain wall module to further include an installing groove and an installing protrusion corresponding to the installing groove, such that the installing groove is disposed at the top of the curtain wall body and the installing protrusion is disposed at the bottom of the curtain wall body, or the installing groove is disposed at the bottom of the curtain wall body and the installing protrusion is disposed at the top of the curtain wall body.

13. The installing method of claim 12, wherein the step of assembling and providing the steel structure module, curtain wall modules, and first waterproof member includes:

configuring the curtain wall module to further include a second seal positioned in the installing groove.

14. The installing method of claim 12, wherein the step of assembling and providing the steel structure module, curtain wall modules, and first waterproof member includes:

configuring the curtain wall module to further include an intermediate member of a shape corresponding to the installing protrusion and the installing groove, the intermediate member being movably disposed in the installing groove along the left-right direction, the intermediate member being used to cover the part of the splicing gap between the adjacent curtain wall modules in the installing groove when at least two curtain wall modules are spliced along the left-right direction; and/or configuring the curtain wall module to further include a waterproof glue piece used to cover the part of the splicing gap at the top of the curtain wall module when at least two curtain wall modules are spliced along the left-right direction, the waterproof glue piece being positioned outside the installing groove.

15. The installing method of claim 10, wherein the step of assembling and providing the steel structure module, curtain wall modules, and first waterproof member includes:

configuring the curtain wall module to further include a third seal positioned on an end surface of at least one of left and right ends of the curtain wall body, such that when at least two curtain wall modules are spliced along the left-right direction, the third seal is positioned at the splicing gap between the adjacent curtain wall modules to seal the splicing gap between the adjacent curtain wall modules.

16. The installing method of claim 15, wherein the step of assembling and providing the steel structure module, curtain wall modules, and first waterproof member includes:

configuring the first waterproof member to have a cross-section of a T-shaped structure, and providing the first seal abutting on either side of both ends of a transverse arm of the T-shaped structure, such that the third seal, the T-shaped structure, and the first seal form a multi-layer sealing structure at a splicing gap.

17. The installing method of claim 10, wherein the step of assembling and providing the steel structure module, curtain wall modules, and first waterproof member includes:

providing a gap between the steel structure body and the curtain wall body;

configuring the steel structure body to have an internal space and an opening in communication with the internal space; and configuring the steel structure module to further include a frame disposed in the gap, wherein one end of the frame is connected to the opening of the steel structure body, and the other end of the frame is used to be sealingly connected with the curtain wall body, such that the frame and the opening defines a channel, and at least one of a surface forming the channel and a surface forms the internal space is provided with a fireproof layer.

18. The installing method of claim 10, wherein the step of assembling and providing the steel structure module, curtain wall modules, and first waterproof member includes:

providing a gap between the steel structure body and the curtain wall body, and configuring the steel structure module to further include a second waterproof member disposed in the gap, such that a first end of the second waterproof member is circumferentially connected to the surface of the steel structure body facing the curtain wall module, and a second end of the second waterproof member is opposite to the first end and used to be glued to the surface of the curtain wall body facing towards the surface of the steel structure body.

* * * * *